United States Patent [19]

Kleckers

[11] 4,401,214

[45] Aug. 30, 1983

[54] DUAL COMPONENT MIXING PACKAGE

[75] Inventor: Bent Kleckers, Fredericia, Denmark

[73] Assignee: I. C. Moller a/s, Fredericia, Denmark

[21] Appl. No.: 309,483

[22] Filed: Oct. 7, 1981

[30] Foreign Application Priority Data

Oct. 7, 1980 [DK] Denmark ..... 4220/80

[51] Int. Cl.[3] ..... B65D 25/08; B67B 7/26

[52] U.S. Cl. ..... 206/219; 206/220; 206/222; 222/83.5

[58] Field of Search ..... 206/219, 220, 221, 222, 206/568, 229; 229/56, 57; 141/331, 338; 222/83, 83.5, 88, 567; 366/129, 130, 349

[56] References Cited

U.S. PATENT DOCUMENTS

| | | | |
|---|---|---|---|
| 3,082,867 | 3/1963 | Gelpey | 206/221 |
| 3,157,312 | 11/1964 | Kitterman | 206/229 |
| 3,730,336 | 5/1973 | Feldman | 206/229 |
| 3,804,322 | 4/1974 | Ericson | 229/57 |
| 4,081,077 | 3/1978 | Franck | 206/219 |

FOREIGN PATENT DOCUMENTS

| | | | |
|---|---|---|---|
| 2359677 | 6/1975 | Fed. Rep. of Germany | 222/567 |
| 1366310 | 6/1964 | France | 206/219 |

*Primary Examiner*—William T. Dixson, Jr.
*Assistant Examiner*—Brenda J. Ehrhardt
*Attorney, Agent, or Firm*—Antonelli, Terry & Wands

[57] ABSTRACT

In a dual component packing of the type consisting of a flexible bag, which contains the single liquid components in respective separate compartments, from which they may be brought together into a common mixing compartment by exterior manipulation, a mixing stick is mounted inside the packing so as to be seizable at one end by squeezing together the bag sheet material thereabout, whereafter the free end of the mixing stick by exterior manipulation can be moved around in the mixing compartment for effectively stirring and mixing the combined liquid components. Exterior pressure manipulations on the bag itself will be superfluous, and for this reason a packing of a simple flat bag type may be bottomwise designed so as to assume a cup shaped form when placed on a substantially planar support surface, whereby an effective mixing stirring by means of the said mixing stick is achievable.

11 Claims, 6 Drawing Figures

DUAL COMPONENT MIXING PACKAGE

Figure 1:
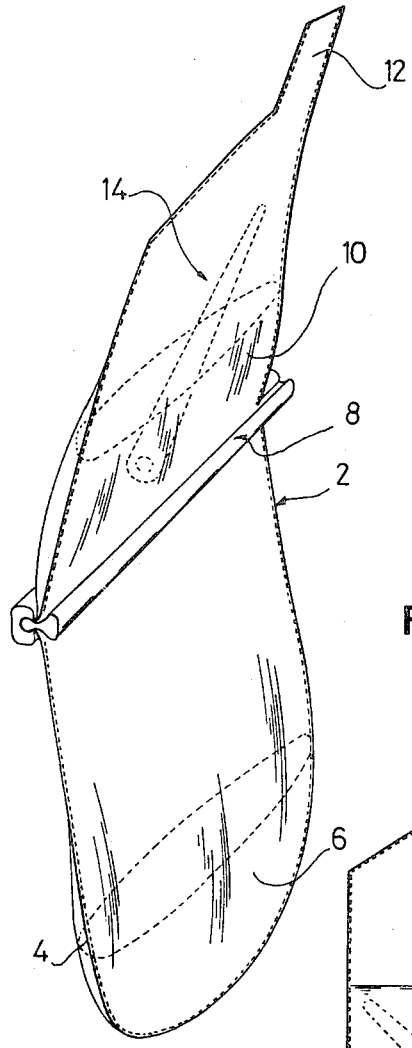

The present invention relates to a dual component mixing package comprising a bag of a strong and flexible sheet material which is divided in at least two compartments each containing the respective components, the bag being manipulatable from its outside for bringing together the components in a common portion of the bag, e.g. by removal of outer elongate clamp means effectively dividing a flat type bag packing into individual compartments, and further being manipulatable from outside for enabling the components to be effectively mixed prior to their being let out from the bag.

It is known to use a mixing package of this type e.g. for the preparation of a polyurethane foam producing liquid for heat insulation purposes, whereby the two liquid components are brought together and caused to be mixed by exterior manipulation of the soft and flexible bag member. Soon thereafter, before the mixed liquid starts foaming up, the bag is opened, e.g. by cutting away a corner portion thereof, and the mixed liquid is poured into the cavity to be heat insulated. This method is advantageous for use in connection with insulation works in situ on pipe joints in a district heating pipe system of prefabricated insulated pipes. Formerly the foam liquid was prepared and mixed in an open cup, but it was recognized that the operators were thereby subjected to poisonous gases from the mixture, and the use of closed mixing bags, therefore, constitutes an important development.

However, in order to obtain a really thoroughly and uniformly mixed product, the mixing bag should be manipulated extremely carefully, and when time is short before the mixed product shall have to be poured out, then a satisfactory result may be very difficult to achieve.

It is the purpose of this invention to provide a mixing package which enables the mixing to be carried out in a rapid and effective manner without necessarily departing from a simple bag design of the package.

According to the invention a mixing tool such as a simple elongate stirring stick is located at least partly inside the bag such that one end thereof is manually seizable from the outside of the bag while the opposite end thereof is located or localizable freely projecting into the common portion of the bag. Such a mixing tool, even if housed entirely within the bag, is easily seizable from the outside of the bag and operable to effect a regular stirring of the liquid to be mixed, as comparable to the stirring in an open cup, and the mixing efficiency is hereby increased considerably compared to the effect of purely exterior manipulations of the bag.

Thus, there will be no need to manipulate the bag, and the bag may even with advantage be placed stationarily on a rigid support during the stirring operation. When the package is of the simple flat bag type the contour of the bag bottom may be downwardly curved, whereby the bag bottom portion, when placed on a flat support, will adopt the shape of a cup, which will promote the efficiency of the stirring operation.

The mixing tool may even be used to hold a funnel member for facilitating the pouring out of the mixed liquid through a narrow hole, and additionally the tool may be used for puncturing the bag in a simple manner, all as explained below.

Figure 2:
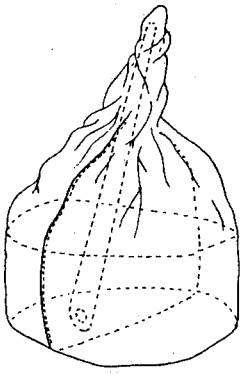
Figure 3:
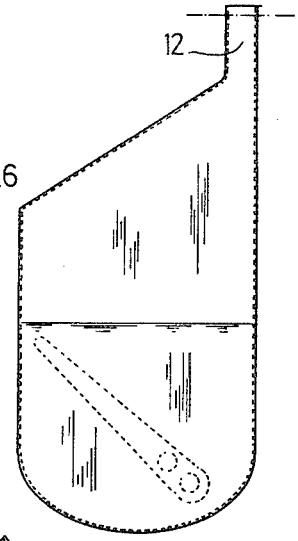
Figure 4:
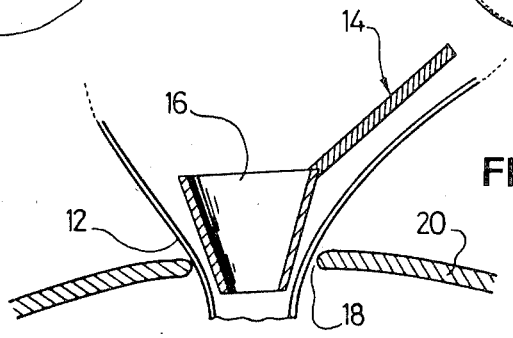
Figure 5:
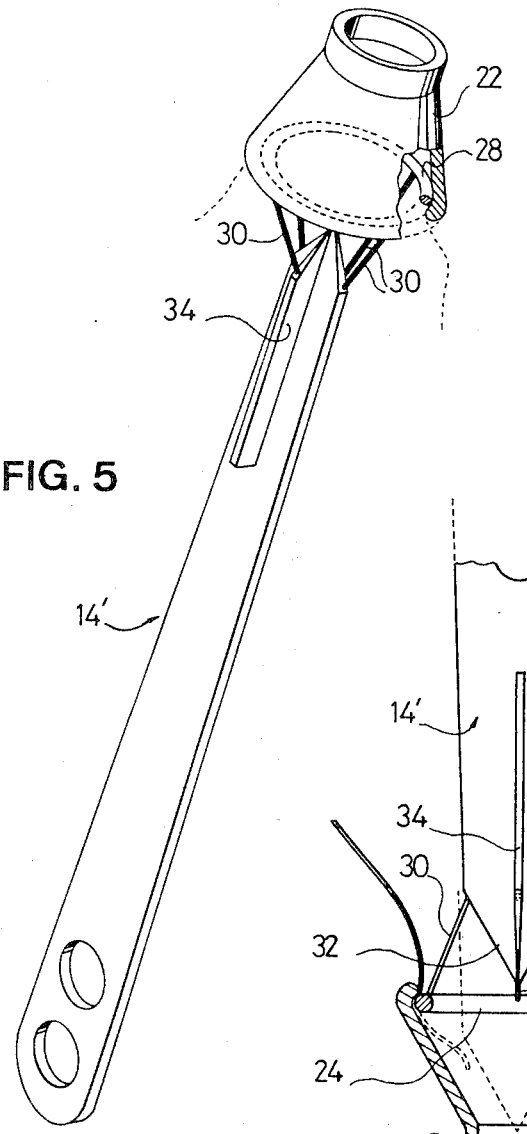
Figure 6:
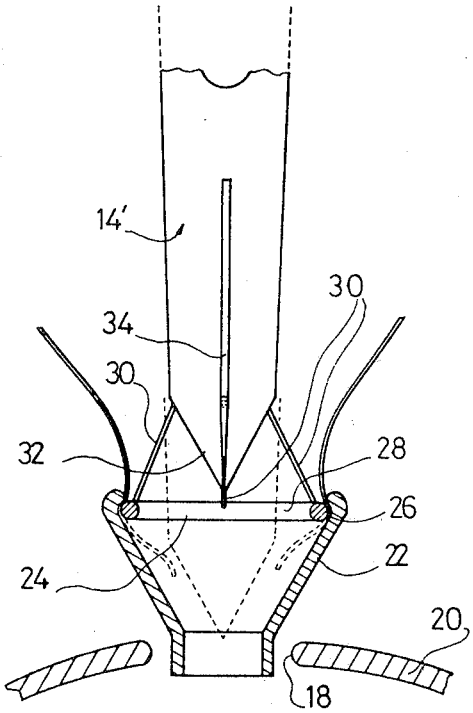

In the following the invention is described in more detail with reference to the drawing, in which:

FIG. 1 is a perspective view of a package according to the invention, shown before use, FIG. 2 the same shown in a mixing position, FIG. 3 is a plan view of the package after the mixing, FIG. 4 is a fractional sectional view illustrating the emptying of the package, FIG. 5 is a perspective view of a modified mixing stick, and FIG. 6 is a sectional view illustrating the use of this stick for emptying the package.

The dual component mixing package shown in FIG. 1 consists of a flat bag generally designated by the reference numeral 2 of a relatively strong, but flexible sheet material, the edge welding of the flat bag being designated 4. The bottom part 6 of the bag contains a liquid component. The bottom edge of the bag is distinctly curving downwards.

Somewhat above the liquid in the bottom 6 a set of clamping cleats 8 creating a tight closure of the bag portion 6 is mounted across the bag, and in the bag part 10 above the cleats 8 is located another liquid component, the bag being edge welded also along the edges of the entire upper part thereof; a final welding closure is of course not effected until after the successive filling of the bag with the two liquid components, but besides, the production method of the filled packing is of no particular importance to the invention.

Topwise the package has a spout formed as a flat tubular portion 12, which is topwise closed by welding. Inside the upper bag part 10 is located, in addition to the liquid component, a mixing stick generally designated by the reference numeral 14, which, however, might as well be located inside the bottom part 6.

When the contents of the bag is to be used the clamping cleats 8 are dismounted, whereby all the liquid gathers in the bottom 6, and the package is placed on a relatively flat support, e.g. on the slightly curved upper side of a thick pipe at the working place, whereby the downwardly curved bag bottom will make possible that the package, when standing, will be able to spread out at the bottom to an almost regular cup-shape as shown in FIG. 2.

It is possible, from the outside of the package, to manually get hold of the mixing stick 14, and by packing together the bag sheet material around the stick, as indicated in FIG. 2, the lower part of the mixing stick can be used to mix the liquids in a manner as effective or almost as effective as mixing in an open cup.

When the mixing is finished, the spout 12 is found and its top end is cut off as indicated by a dotted line in FIG. 3, whereafter the ready mixed contents can be poured out. The package with the mixing stick 14 can then be put away for destruction.

For the formation of a reasonably corner- and crease-free bottom portion 6 of the bag in the supported position thereof as shown in FIG. 2 the bottom edge of the bag may have a shape other than evenly curved, e.g. broken as shown with a dotted line in FIG. 3.

The straight tube shape of the spout 12 gives the advantage that it is easy to keep the spout effectively closed by squeezing it with the fingers, while the end of the spout is being cut off.

In FIG. 4 is shown that the mixing stick 14 may be provided with an outlet funnel member 16 at one end thereof, preferably shaped in one piece with the stick 14. When the mixed product is to be poured out the funnel 16 is eased into an upper hole 18 in a wall portion 20 of a receiver container or cavity, the funnel hereby being located inside the spout portion 12 or inside the remainder of a cut off bag corner portion. The funnel 16 could well be joined, e.g. by welding, to the bag sheet material, even with the latter covering the opening of the funnel, whereby for the emptying of the bag it would be sufficient to puncture the sheet material closing the funnel. The funnel opening could even be blocked by a removable stopper or screw stopper.

In FIGS. 5 and 6 is shown an embodiment comprising a funnel element 22 mounted on the outside of a wall portion 24 of the bag, the funnel element having at its broad end an interior annular recess 26, in which the bag sheet material is held by the clamping action of a ring member 28 which, by means of a number of thin rod portions 30, is connected with the outer, pointed end 32 of an implement preferably constituted by a mixing stick generally designated by the reference numeral 14', which is at this end provided with lateral ribs 34, which are likewise pointed towards the end of the implement.

The bag belonging to this embodiment need not have any special spout portion 12. When the bag is to be emptied, the funnel member 22 is brought to communicate with the hole 18 as shown in FIG. 6, and the stick 14' is forced downwardly, whereby its pointed end will penetrate the bag wall portion 24, while the thin connector rods 30 will bend or break.

The funnel 22 may be premounted on the bag or supplied as a separate member for easy mounting in engagement with the ring member 28. Moreover, the bag sheet portion 24 may be punctured from outside, whereby the ring member 28 should not necessarily be connected with an interior mixing tool.

The invention is not limited to the embodiments shown and especially not to the manner by which the package is divided in compartments for each of the liquid components and for the mixing member 14 or 14'. This member may from the beginning be placed in an individual portion of the package, or it may be welded to an edge portion of the package. It may alternatively be placed outside the package and be forced in through a wall portion thereof, e.g. through the spout 12, when the mixing is to be done according to FIG. 2, whereby the possibility of a small degree of escape of gas would have to be tolerated.

What is claimed is:

1. A dual component mixing package comprising a bag of a strong and flexible sheet material, means for dividing the bag into at least two compartments, each of said compartments containing the respective components, the bag being manipulatable from outside thereof for bringing together the components in a common portion of the bag, and means manipulatable from outside of the bag for enabling the components to be effectively mixed prior to being emptied from the bag, characterized in that the means for enabling the components to be effectively mixed includes a mixing tool including an elongate stirring rod located entirely inside one of the individual compartment such that one end of the stirring rod is manually seizable from the outside of the bag while an opposite end thereof is freely projectible into said common portion of the bag.

2. A package according to claim 1, shaped substantially as a flat bag, characterized in that a bottom portion of the flat bag has a convex shape such that the bottom of the filled flat bag, hen placed on a substantially planar support surface with the components brought together in the bottom portion of the bag, will be widened to form a mixing chamber free of unaccessible, partly closed pockets and sharp corners as seen in a peripheral direction as well as across the flattened bottom surface.

3. A package according to one of claims 1 or 2, characterized in that the bag is shaped with an outlet spout portion in the form of an elongate flat tubular portion formed by opposed sheet portions and closed at its outer end so as to be openable by cutting off the outer end thereof.

4. A package according to one of claims 1 or 2, characterized in that the mixing tool further includes a funnel means on the freely projectable end thereof for enabling an emptying of the components from the bag through a wall portion thereof.

5. A package according to claim 4, characterized in that one of the ends of the mixing tool includes means for puncturing the wall portion of the bag.

6. A package according to claim 5, characterized in that the means for puncturing are disposed on the free projectible end of the mixing tool.

7. A package according to claim 1, characterized in that means are provided for facilitating an emptying of the bag including a funnel means, means are provided for mounting the funnel means on the mixing tool, and means are provided for puncturing a wall portion of the bag so as to enable an emptying thereof through said funnel means.

8. A package according to claim 7, characterized in that the means for mounting includes an annular member adapted to be mounted in the funnel means in such a manner that the wall portion of the bag is interposed between the annular member and an inner surface of the funnel means, and in that means are provided for mounting the annular member to the freely projectible end of the mixing tool.

9. A package according to claim 8, characterized in that the means for puncturing includes a pointed tip formed on the freely projectible end of the mixing tool, and in that the means for mounting the annular member to the mixing tool includes releasable means for enabling the pointed tip to be projected into the annular member.

10. A package according to claim 9, characterized in that the releasable means includes a plurality of connecting rods disposed between the mixing tool and the annular member.

11. A package according to claim 7, characterized in that the means for dividing includes an outer elongate clamp means for effectively dividing the bag into the individual compartments.

* * * * *

UNITED STATES PATENT AND TRADEMARK OFFICE

CERTIFICATE OF CORRECTION

PATENT NO. : 4,401,214

DATED : August 30, 1983

INVENTOR(S) : Bent KLECKERS

It is certified that error appears in the above-identified patent and that said Letters Patent are hereby corrected as shown below:

At "[21]" change "Application No. 309,483" to - - Application No.: 309,486 - - .

Signed and Sealed this

*Twenty-fifth* Day of *October 1983*

[SEAL]

*Attest:*

GERALD J. MOSSINGHOFF

*Attesting Officer*

*Commissioner of Patents and Trademarks*